US005282458A

United States Patent [19]

Trimble

[11] Patent Number: 5,282,458

[45] Date of Patent: Feb. 1, 1994

[54] GASEOUS FUEL FIRED PORTABLE COOKING APPARATUS

[76] Inventor: Eldridge P. Trimble, P.O. Box 923, St. Martinville, La. 70582

[21] Appl. No.: 79,650

[22] Filed: Jun. 17, 1993

[51] Int. Cl.[5] ..... A21B 1/00

[52] U.S. Cl. ..... 126/373; 126/387; 99/408

[58] Field of Search ..... 126/373, 387, 390; 99/408

[56] References Cited

U.S. PATENT DOCUMENTS

| | | | |
|---|---|---|---|
| 1,264,740 | 4/1918 | Young | 99/408 |
| 1,994,555 | 3/1935 | Wilson | 99/408 |
| 1,996,434 | 4/1935 | O'Dowd | 99/408 |
| 2,000,609 | 5/1935 | Pitman | 99/408 |
| 2,125,862 | 8/1938 | Ratcliff | 126/390 |
| 2,338,964 | 1/1944 | Pappas | 99/408 |
| 2,918,861 | 12/1959 | Phelan et al. | 99/408 |
| 3,259,521 | 7/1966 | Crall | 99/408 |
| 4,762,114 | 8/1988 | Blankemeyer | 126/373 |

*Primary Examiner*—Carroll B. Dority

*Attorney, Agent, or Firm*—Pravel, Hewitt, Kimball & Krieger

[57] ABSTRACT

An outdoor cooking apparatus relating to an improved gaseous fuel fired cooking apparatus that has a burner frame supporting a removable cooking vessel for containing liquid such as cooking oil, or the like using a fuel source (such as propane or butane) contained in a canister with a conduit to supply the fuel to one or more vertically oriented nozzles that are offset with respect to the central longitudinal axis of the vessel, so that an offset application of heat to the vessel insures a rotation of liquid flow within the vessel during use and wherein a trap portion of the vessel spaced away from the heat source to collect sediment (such as pieces of food or batter).

11 Claims, 2 Drawing Sheets

GASEOUS FUEL FIRED PORTABLE COOKING APPARATUS

BACKGROUND OF THE INVENTION

Field of the Invention

The present invention relates to outdoor cooking apparatus and more particularly relates to an improved gaseous fuel (e.g. butane or propane) fired cooking apparatus that has a burner frame supporting a removable cooking vessel for containing liquid such as cooking oil, or the like. More particularly the present invention relates to an improved outdoor cooking apparatus that uses a fuel source (such as propane or butane) contained in a canister with a conduit to supply the fuel to one or more vertically oriented nozzles that are offset with respect to the central longitudinal axis of the vessel, so that an offset application of heat to the vessel insures a rotation of liquid flow within the vessel during use and wherein a trap portion of the vessel spaced away from the heat source to collect sediment (such as pieces of food or batter).

General Background

Various portable cooking devices are commercially available that use a source of gaseous fuel (such as propane or butane) that is contained in a canister. These canisters can be disposable or refillable. One common propane and butane containing canister is a five (5) gallon size having a valve at the top of the canister. Such canisters are typically used in combination with a commercially available regulator for regulating the flow of the gaseous fuel substance from the canister to a burner. Flexible hoses equipped with fittings are used to transmit the gaseous fuel substance from the canister to a burner. Typically, a quick disconnect fitting such as a threaded brass fitting is used to connect the burner to the source of fuel at the hose.

It is known in the art to manufacture a metallic welded burner having a tripod leg arrangement that includes inclined leg structures having curved feet. It is also known to use a single burner placed at the center of the burner frame that is equipped with a nozzle jet that directs its flame upwardly along a vertical path and through a cylindrical shroud. These types of portable cookers are typically used in combination with a large metal pot for cooking outdoors.

Many heating and cooking devices have used removable vessels and/or a source of gaseous substance to heat a vessel containing liquid. Examples include the O'Dowd U.S. Pat. No. 1,996,434 entitled "Liquid Heating Apparatus"; the Young U.S. Pat. No. 1,264,740 entitled "Frying Apparatus", the Wilson U.S. Pat. No. 1,994,555 entitled "Frying Apparatus"; and the Phelan et al. U.S. Pat. No. 2,918,861 entitled "Equalizer for Pressure Cookers".

The Young U.S. Pat. No. 1,264,740 shows a trap mounted at the bottom of a vessel for containing sediment. A pair of generally parallel, offset pipes are used to channel fuel to nozzles that emit gas that is ignited to heat the vessel along its length on opposite sides of the trap. U.S. Pat. Nos. 2,000,609; 2,125,862; and 2,338,964 all describe cooking devices having traps below the burner line to accumulate debris for later removal without burning.

U.S. Pat. No. 3,259,521 issued to Crall and entitled "Filter System and Method for Pressure Cookers" relates to a filter system for a pressure cooker of the type using cooking oil.

SUMMARY OF THE PRESENT INVENTION

The present invention provides an improved cooking apparatus that uses a burner support frame having a plurality of at least three legs, each leg having upper and lower end portions, an upper support ring attached to the upper end of each leg, the upper ring having a peripheral portion that surrounds an opening having a central vertical axis.

A smaller, lower support ring is supported below the larger ring, the smaller ring having a peripheral portion and a central opening with a central vertical axis that is substantially coincident with the central axis of the opening of the larger ring.

A burner element is supported upon the burner support at the lower ring and includes a pair of vertically oriented nozzles having a flame axis that is generally vertically extending for directing a flame upwardly along the flame axis, but offset from the central vertical axis of the burner support. A conduit supplies gaseous fuel to the burner element and nozzles for supporting combustion at the nozzles.

An inlet is provided for connecting a source of gaseous fuel such as propane or butane under pressure to the conduit.

A cooking vessel is removably supported upon the burner support frame and includes a continuous side wall and bottom wall that define a space for holding liquid such as cooking oil during use. The vessel includes a smaller diameter portion that fits within the lower ring during use. The vessel includes a larger diameter cylindrical portion that registers with the larger ring.

During use, flames emitted above the nozzle register with a frustro-conical portion of the vessel that is positioned in between the upper cylindrical and lower cylindrical portions. The flame axis is positioned laterally away from and generally parallel to the axis of the larger ring. The burner nozzles are positioned within the confines of about one half to one third of the vessel frustro-conical portion (or less) so that a direct flame is applied to only about one half to one third portion of the vessel during use. No direct flame is applied to the other two thirds portion of the vessel during use. This creates a "offset" of heat transfer to the vessel during use that promotes a rolling boil effect.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
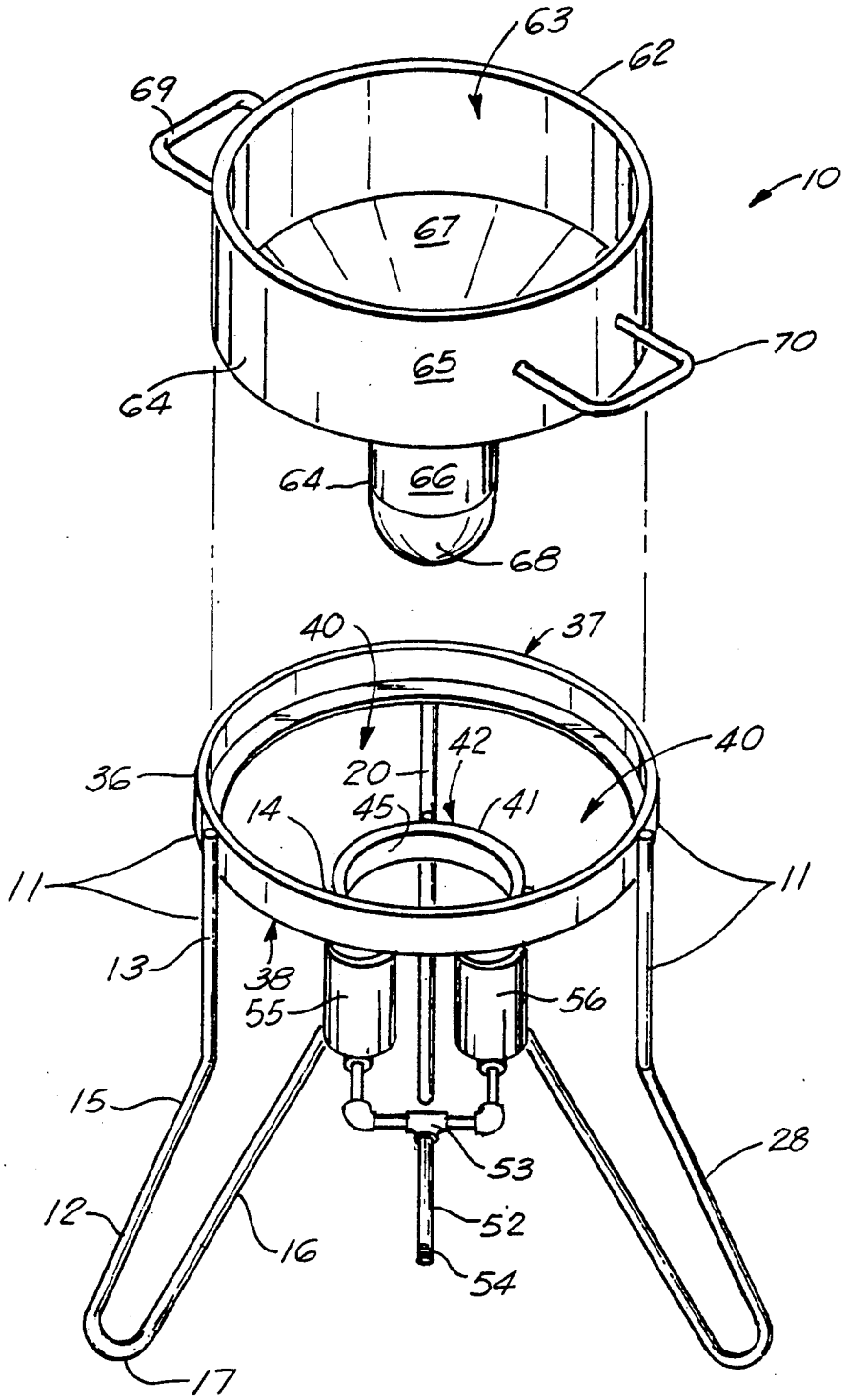
FIG. 1 is a perspective view of the preferred embodiment of the apparatus of the present invention.
Figure 2:
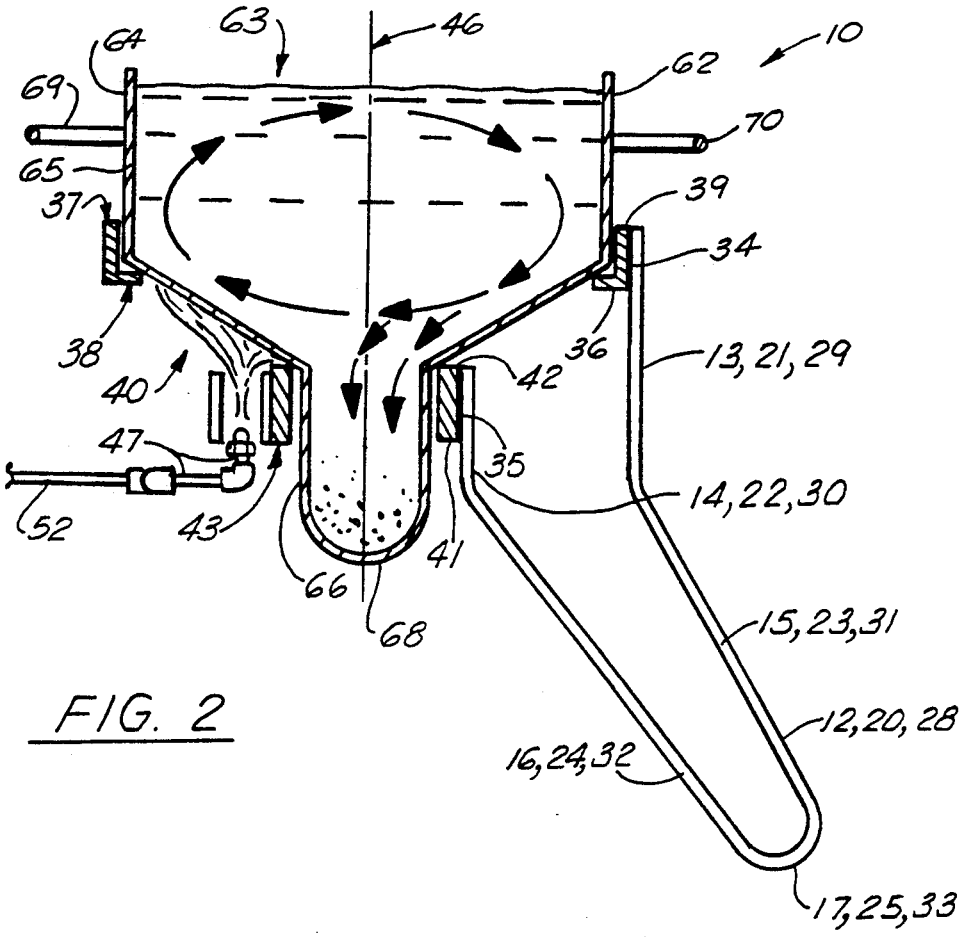
FIG. 2 is a partial sectional elevational view of the preferred embodiment of the apparatus of the present invention.
Figure 3:
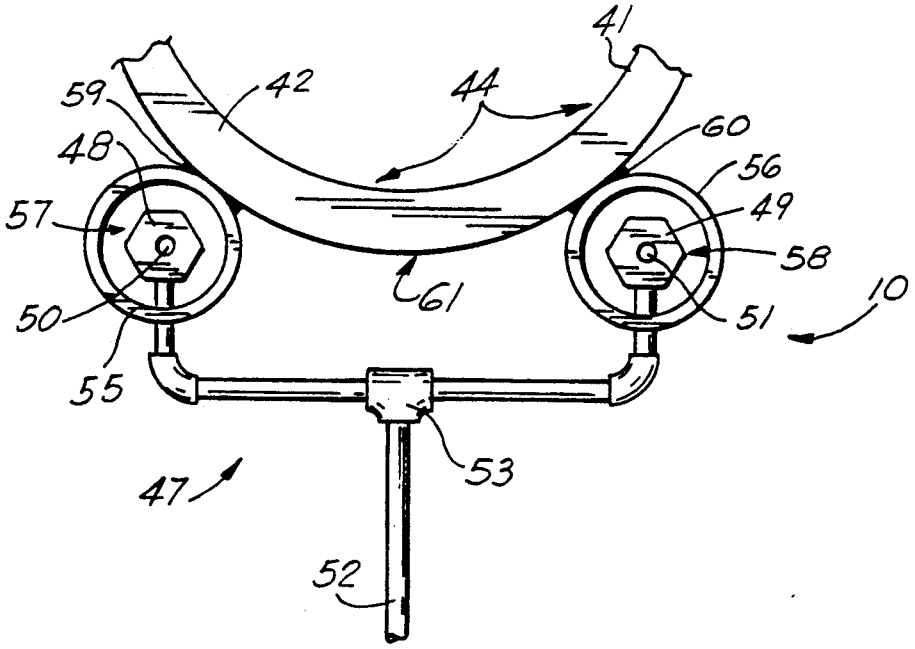
FIG. 3 is a top fragmentary view of the preferred embodiment of the apparatus of the present invention illustrating the burner portions thereof.

FIGS. 1-3 show the preferred embodiment of the apparatus of the present invention designated generally by the numeral 10.

Cooking apparatus 10 includes a structural burner frame 11 made of welded steel such as stainless steel for example. The burner frame is provided with a plurality of legs 12, 20, 28. The leg 12 includes a vertical section 13, a vertical section 14, and a pair of inclined sections 15, 16. The inclined sections 15, 16 communicate with curved foot 17. Leg 12 is welded to upper and lower cylinders 36, 41 at the vertical sections 13, 14 respectively. Similarly, the leg 20 provides vertical sections 21, 22 inclined sections 23, 24, and welds 26, 27 for attaching the leg 20 to the upper and lower cylinders 36, 41.

The third leg 28 provides vertical sections 29, 30, inclined sections 31, 32, curved foot 33. Welds 34, 35 attach the vertical sections 29, 30 to upper cylinder 36 and lower cylinder 41 respectively. Upper cylinder 36 includes a cylindrical wall 39, an upper surface 37, and a lower surface 38. A central vertical opening 40 extends through upper cylinder 36, being open-ended.

Lower cylinder 41 is a much smaller cylinder than upper cylinder 36. The lower cylinder 41 includes an upper edge 42, a lower edge 43, a central vertical opening 44 that is open ended. Lower cylinder 41 likewise provides a cylindrical sidewall 45.

Burner frame 11 has a central longitudinal vertical axis 46 that also defines the central vertical axis of upper cylinder 36 and lower cylinder 41. A burner 47 is mounted to burner frame 11. Burner 47 includes a pair of nozzles 48, 49 through which a fuel substance such as propane or butane is emitted during use for purposes for creating a combustion directly above the nozzle 48, 49. Nozzles 48, 49 are upwardly directed, each providing a vertically extending flame axis 50, 51 respectively during use. In this manner, the nozzles 48, 49 are directed upwardly to provide two substantially vertically oriented flames that track the flame axes 50, 51. Conduit 52 provides a gas fuel substance to the pair of nozzles 48, 49 via a tee connection 53. A removable connection is formed between conduit 52 and a source of pressurized gaseous fuel such as propane or butane in the form of quick connect inlet fitting 54. Such fittings 54 are commercially available. Thus, fuel can be supplied to burner 47 at inlet fitting 54 using a butane or propane tank fitted with a commercially available regulator and a flexible rubber hose for example. It should be understood that the tank, hose, regulator and hose fittings are commercially available staple items well known in the art. Each nozzle 48, 49 is surrounded by a burner shroud 55, 56 respectively. The burner shrouds 55, 56 each provide vertical open-ended bores 57, 58. Each burner shroud 55, 56 is affixed to burner frame 11 by welding for example at welds 59, 60. The burner shrouds 55, 56 can be affixed by welding to the outer surface 61 of smaller, lower cylinder 41 as shown in FIG. 2. Vessel 62 can be a one piece metallic vessel such as stainless steel for example. Vessel 62 has an open top 63, a continuous annular side wall 64, and a bottom 68. The side wall 64 comprises a larger cylindrical portion 65, a smaller cylindrical portion 66, and a frustro-conical portion 67. The smaller cylindrical portion is closed at the bottom portion thereof with curved bottom portion 68.

A pair of spaced apart handles 69, 70 allow vessel 62 to be lifted so that the vessel 62 can be removed completely from burner support frame 11 as shown in the exploded view of FIG. 4.

During use, it can be seen that the flame axis 50, 51 are spaced laterally away from and generally parallel to central vertical axis 46. This produces an offset of the heat applied directly to vessel 62. During use, vessel 62 nests within burner frame 11. The smaller cylindrical portion 66 of vessel 62 registers in lower cylinder 41, the smaller cylindrical portion 66 occupying the opening 44. Similarly, the upper larger cylindrical portion 65 of vessel 62 nests in upper cylinder 36 as shown in FIG. 1. The larger cylindrical portion 65 occupies opening 40.

The following table lists the part numbers and part descriptions as used herein and in the drawings attached hereto.

PARTS LIST

| Part Number | Description |
|---|---|
| 10 | cooking apparatus |
| 11 | burner frame |
| 12 | leg |
| 13 | vertical section |
| 14 | vertical section |
| 15 | inclined section |
| 16 | inclined section |
| 17 | curved foot |
| 18 | weld |
| 19 | weld |
| 20 | leg |
| 21 | vertical section |
| 22 | vertical section |
| 23 | inclined section |
| 24 | inclined section |
| 25 | curved foot |
| 26 | weld |
| 27 | weld |
| 28 | leg |
| 29 | vertical section |
| 30 | vertical section |
| 31 | inclined section |
| 32 | inclined section |
| 33 | curved foot |
| 34 | weld |
| 35 | weld |
| 36 | upper cylinder |
| 37 | upper surface |
| 38 | lower surface |
| 39 | cylindrical wall |
| 40 | opening |
| 41 | lower cylinder |
| 42 | upper edge |
| 43 | lower edge |
| 44 | opening |
| 45 | cylindrical wall |
| 46 | central vertical axis |
| 47 | burner |
| 48 | nozzle |
| 49 | nozzle |
| 50 | flame axis |
| 51 | flame axis |
| 52 | conduit |
| 53 | tee |
| 54 | inlet fitting |
| 55 | burner shroud |
| 56 | burner shroud |
| 57 | open ended bore |
| 58 | open ended bore |
| 59 | weld |
| 60 | weld |
| 61 | outer surface |
| 62 | vessel |
| 63 | open top |
| 64 | side wall |
| 65 | larger cylindrical portion |
| 66 | smaller cylindrical portion |

-continued

| PARTS LIST | |
|---|---|
| Part Number | Description |
| 67 | frustro-conical portion |
| 68 | bottom |
| 69 | handle |
| 70 | handle |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A cooking apparatus comprising:

a) a burner support having a plurality of at least three legs, each with upper and lower end portions, and a support ring attached to the upper end portion of each leg, the ring having a peripheral portion that surrounds an opening having a central vertical axis;

b) a smaller ring supported by the burner support below the larger ring, the smaller ring having a peripheral portion with upper and lower edge portions and a central opening having a central vertical axis that is substantially coincident with the central axis of the opening of the larger ring;

c) a burner element supported upon the burner support, and including a nozzle having a flame axis that is generally vertically extending for directing a flame upwardly along the flame axis;

d) a conduit supported upon the burner support, for transmitting gaseous fuel to the burner element and nozzle for supporting combustion at the nozzle;

e) an inlet connection for connecting a source of gaseous fuel under pressure to the conduit;

f) a cooking vessel, removably supported upon the burner support frame, and including a continuous sidewall that defines a space for holding liquid such as cooking oil during use;

g) the vessel including a smaller diameter lower end portion for holding solid matter that settles in the vessel, the lower end portion being vertically extending along an axis that is generally aligned with the axis of the larger and smaller rings, a larger upper end portion communicating with an open top, and a frustro-conically shaped portion extending between the upper and lower portions;

h) wherein the flame axis is positioned laterally away from and generally parallel to the axis of the larger ring, the axis of the smaller ring, and the axis of the vessel; and i) the burner is positioned within the confines of one half of the vessel so that a direct flame is applied to one half portion of the vessel during use and no direct flame is applied to the other half portion of the vessel during use.

2. The apparatus of claim 1 wherein the larger ring is circular in shape.

3. The apparatus of claim 1 wherein the smaller ring is circular in shape.

4. The apparatus of claim wherein the vessel is generally circular in shape.

5. The apparatus of claim 1 wherein the vessel upper and lower end portions are generally cylindrically shaped.

6. The apparatus of claim 1 wherein burner support has three legs that extend along radial lines a distance that terminates beyond the peripheral portion.

7. The apparatus of claim 1 wherein there are two burner nozzles positioned adjacent one another, each positioned to direct a flame to one half portion of the vessel.

8. The apparatus of claim 1 wherein the burners are mounted upon the conduit and the conduit is connected to the frame.

9. The apparatus of claim 1 wherein legs form connections between the smaller ring and the larger ring.

10. The apparatus of claim 9 wherein each leg has inner and outer vertically extending portions including a first inner leg portion that is affixed to the smaller ring and a second outer leg portion that is affixed to the larger ring.

11. A cooking apparatus, comprising:

a) a burner support having a plurality of at least three legs, each with upper and lower end portions, and a support ring attached to the upper end portion of each leg, the ring having a peripheral portion that surrounds an opening having a central vertical axis;

b) a smaller lower ring supported by the burner support below the larger ring, the smaller ring having a peripheral portion with upper and lower edge portions and a central opening having a central vertical axis that is substantially coincident with the central axis of the opening of the larger ring;

c) a burner element supported upon the burner support at the smaller, lower ring, and including a burner shroud with a shroud opening and a burner nozzle positioned within the shroud, the nozzle having a flame axis during use that is generally vertically extending for directing a flame upwardly along the flame axis and through at least a portion of the shroud opening;

d) a conduit supported upon the assembly of the burner support and burner element, for transmitting gaseous fuel to the burner element and nozzle for supporting combustion at the nozzle;

e) an inlet connection for connecting a source of gaseous fuel under pressure to the conduit;

f) a cooking vessel, removably supported upon the burner support frame, and including a continuous sidewall and bottom wall that define a space for holding liquid such as cooking oil during use;

g) the vessel including a smaller diameter lower end portion that fits in the smaller, lower ring for holding solid matter that settles in the vessel, the lower end portion being vertically extending along an axis that is generally aligned with the axis of the larger and smaller rings, a larger upper end portion communicating with an open top, and a frustro-conically shaped portion extending between the upper and lower portions;

h) wherein the flame axis is positioned laterally away from and generally parallel to the axis of the larger ring, the axis of the smaller ring, and the axis of the vessel; and i) the burner element is positioned within the confines of about one half of the vessel or less so that a direct flame is applied to about one half portion of the vessel during use, and no direct flame is applied by the burner element to the other half portion of the vessel during use.

* * * * *